United States Patent [19]

Nugent

[11] 4,377,598

[45] * Mar. 22, 1983

[54] PACKAGE FOR PROTECTING FRIABLE PRODUCTS

[75] Inventor: Frank J. Nugent, Ridgefield, Conn.

[73] Assignee: General Foods Corporation, White Plains, N.Y.

[ * ] Notice: The portion of the term of this patent subsequent to May 22, 1996, has been disclaimed.

[21] Appl. No.: 933,432

[22] Filed: Aug. 14, 1978

Related U.S. Application Data

[63] Continuation of Ser. No. 833,205, Sep. 14, 1977, Pat. No. 4,156,022.

[51] Int. Cl.[3] ..... B65B 23/00

[52] U.S. Cl. ..... 426/108; 206/583; 206/585; 206/593; 426/119; 426/124

[58] Field of Search ..... 426/124, 128, 115, 108, 426/119; 229/14 C, 90; 206/593, 583, 585, 594, 591

[56] References Cited

U.S. PATENT DOCUMENTS

| | | | |
|---|---|---|---|
| 1,035,258 | 8/1912 | Stegman | 229/90 |
| 1,220,670 | 3/1917 | Milliron | 426/108 |
| 1,413,064 | 4/1922 | Salfisberg | 426/108 |
| 2,133,122 | 10/1938 | Swain | 426/108 |
| 2,180,465 | 11/1939 | Gelfand | 426/124 |
| 2,263,191 | 1/1941 | Saladin et al. | 426/108 |
| 2,476,923 | 7/1949 | Sogas | 426/108 |
| 2,538,730 | 1/1951 | Kunkler | 426/108 |
| 2,961,141 | 11/1960 | Lukes | 206/303 |
| 3,064,872 | 11/1962 | Skirow | 206/591 X |
| 3,162,539 | 12/1964 | Repko | 422/122 |
| 3,343,671 | 9/1967 | Weinstein | 206/499 |
| 3,386,619 | 6/1968 | Douglas | 206/225 X |
| 3,498,798 | 3/1970 | Baur et al. | 426/124 |
| 3,596,830 | 8/1971 | McFarland et al. | 206/420 |
| 3,852,485 | 12/1974 | Beall | 426/115 |

FOREIGN PATENT DOCUMENTS

| | | | |
|---|---|---|---|
| 473742 | 5/1951 | Canada | 426/128 |
| 711866 | 2/1931 | France | 229/14 |
| 961879 | 6/1964 | United Kingdom | 229/14 C |

*Primary Examiner*—Steven L. Weinstein
*Attorney, Agent, or Firm*—Daniel J. Donovan

[57] ABSTRACT

A packaging arrangement for a generally friable product sealed in a plastic pouch, the latter of which is positioned in a sealed cylindrical container so as to be restrained from axial movement therein. A separator may be located in the container to bias the pouch radially outwardly into engagement with the inner cylindrical surface of the container. Moreover, a corrugated liner may be interposed between the plastic pouch and the inner wall of the container to thereby provide added protection to the friable product from shock loads iparted to the container.

10 Claims, 9 Drawing Figures

PACKAGE FOR PROTECTING FRIABLE PRODUCTS

This is a continuation of application Ser. No. 833,205, filed Sept. 14, 1977, now issued as U.S. Pat. No. 4,156,022 on May 22, 1979.

BACKGROUND OF THE INVENTION

1. Field of the Invention

The present invention relates, in general, to an arrangement for the packaging of an elongated friable, brittle or fragile product in a manner so as to protect the product from physical damage being imparted thereto as a result of shock, impact or generally rough handling. More particularly, the present invention relates to an arrangement for the packaging of an elongated, relatively flat, brittle product, such as an analog bacon strip, in a manner readily applicable to the lengthy storage of and mass distribution of the product.

2. Discussion of the Prior Art

The technology of the packaging of friable or brittle products is highly developed, and some of the individual features incorporated in the present invention may, per se, be known in the art. However, the novel combination of features and structural integers taught by the present invention is not in any manner suggested by the prior art, and offers a very effective and unique mode of packaging for mass distribution of an elongated, flat, or undulating friable and brittle product which is easily susceptible to damage if dropped or roughly handled.

Colburn U.S. Pat. No. 3,648,428 discloses the film-to-film surface-contact packaging of food products in which plastic films are placed above and below the product, and with the films then being subjected to heat and suction in a vacuum-forming machine to thereby sealingly adhere to each other and against the outline of the product. Colburn is not primarily concerned with the packaging of a friable or brittle product in a manner as to afford the product maximum protection from physical damage, but merely concerns himself with protection from spoilage by sealing of the product.

Gulliver U.S. Pat. No. 3,406,814, Heller U.S. Pat. No. 3,591,069, and Moller U.S. Pat. No. 3,905,542 all disclose varied types of packages having apertures which are covered by a sealing film of transparent material in order to provide a dual function of sealing the contents of the container and of allowing a consumer to view the contents of the container. In essence, none of these patents are concerned with the packaging of a friable or brittle product in a manner which will prevent damage to the product when subjected to shock, impact and rough handling.

SUMMARY OF THE INVENTION

Accordingly, in order to overcome or ameliorate the limitations encountered in the prior art, the present invention contemplates the provision of an improved packaging arrangement for elongated, relatively flat or slightly undulating superposed strip-like friable or brittle products, which is particularly effective in affording protection to the packaged product from any damage which would render it unattractive to a purchaser or ultimate consumer, and thereby render it suitable for mass distribution of the product.

Pursuant to a preferred embodiment of the invention, there is disclosed a packaging arrangement for an elongated friable or brittle product in which a cylindrical container is adapted to receive at least one vacuum-sealed pack retaining snugly and in an immobile manner at least one stack of several elongated, friable product strips, with the strips being positioned with their lengths oriented to extend along the length of the container. Furthermore, in the disclosed embodiment of the invention, the vacuum-sealed pack or pouch holds in a plurality of sealed pockets separate stacks of friable products, and the vacuum-sealed pack is folded or creased intermediate the stacks so as to generally conform to the cylindrical inner wall of the container. Moreover, in the disclosed embodiments of the invention the cylindrical container is adapted to receive and store one or more vacuum packs therein, each of which is foldable or creasable intermediate the respective product-containing pockets thereof, and with each stack extending towards the center of the container. Additionally, in the disclosed embodiments of the invention, each of the vacuum packs is at least substantially equal to the length of the container, and each having a flange at least at one end thereof which is supported on the bottom of the container to provide resiliency or spring action for absorbing any shocks the container might encounter. Furthermore, each container is filled with an inert gas for protection of the products contained therein from any deleterious effects of oxygen and moisture.

In one embodiment, the container is also provided with a partition or separator positioned between at least some of the stacks of products, with the partition having the shape of a four-pointed star in cross-section, with each edge, respectively forming a point of the star, being positioned between two adjacent stacks of products so as to have at least two points of the partition bias the vacuum packs or pouches radially outwardly towards engagement with the inner wall surface of the cylindrical container.

In a somewhat modified embodiment of the invention, the separator may be a substantially rigid flat plate member which generally diametrically bisects the container so that the end edges of the separator extend between, respectively, two adjacent stacks of products on opposite sides of the inner circumferential wall of the container, thereby biasing the vacuum packs or pouches radially outwardly into engagement with the inner wall of the container.

In addition, in the disclosed embodiments of the invention, the cylindrical container may also be provided with a corrugated liner extending along the cylindrical inner wall thereof and which is interposed between the outer surface of the product-containing packs or pouches and the container wall to thereby afford added shock and impact resistant protection to the product stored therein.

In greater particularity, the invention comtemplates the provision of a number of structural integers forming, in combination, a novel and unique packaging arrangement for elongated, relatively flat or undulating friable products, such as elongate analog bacon strips. The elongated product strips are stacked in a flat, superposed relationship, and two parallel spaced stacks of the products are each vacuum sealed in separate pockets in a plastic pouch having a single base wall portion, each pocket being in intimate and snug immobilizing contact with the product contained therein. The pouch is creased or curved intermediate the two product stacks or pockets and positioned within a cylindrical container with the stacks extending axially thereof and projecting radially inwardly of the container. In one embodiment of the invention, the width of the pouch covers approximately one-half or 180° of the circumferential surface of the cylindrical container. The container may have a corrugated liner positioned to extend along its inner cylindrical surface contacted by the base wall portion of the pouch containing the friable products. A second similarly curved or creased pouch is positioned so as to encompass the other half of the inner circumferential wall surface of the cylindrical container. The length of the pouches is approximately equal to the height of the container interior, each pouch being formed with a flange at least at one end thereof, which is positioned to engage the bottom of the container and thereby act as a resilient member or spring which will absorb any axially acting shock loads to which the container might be exposed. An elongate paper or cardboard insert having the cross-section of a four-sided star is then placed in the container so as to have the pointed outer edges thereof extend, respectively, between the four stacks and to separate the stacks with a slight radially outwardly acting spring action and to press the pouches immobile against the inside cylindrical wall of the container to thereby further protect the products against radial movement and shock loads.

Alternatively, the width of the pouch may cover substantially 360° or the full circumferential surface of the inner cylindrical wall of the container. An elongate paper or cardboard insert formed of a substantially rigid flat plate member may be positioned in a manner to essentially diametrically bisect the container and dimensioned to have the end edges thereof extend between oppositely located stacks in the pouch so as to press the pouch against the inside cylindrical wall of the container.

The cylindrical container is filled with an inert gas, such as nitrogen, to protect the product stored therein against the deleterious effects of oxygen and moisture. The container is sealed on top through the intermediary of a sealed cap, preferably an easy-open, peel-off metallic cap, while the bottom may be closed by any suitable plate-like closure member, such as those used for the sealing of cans. A removable plastic cap may be detachably mounted over the metallic cap so as to allow the consumer to reseal the container after the peel-off metallic cap has been removed. This packaging arrangement protects the friable products against very high shock and impact loads with very little danger of breakage of the product, and is also adapted to provide an attractive packaging arrangement with widespread consumer appeal.

Accordingly, it is a primary object of the present invention to provide a novel packaging arrangement for an easily fractured friable or brittle product, which provides a maximum amount of protection to the packaged product and which also is suitable for long-term storage and mass distribution in the consumer market.

Another object of the present invention is to provide an arrangement of the type described wherein the friable product in the form of strips is stacked one upon another and then vacuum-sealed in pockets formed by a plastic film material so that the pouch is in intimate surface-to-surface contact with the product strip stacks and snugly holds them immobile within the pouch.

A more specific object of the present invention lies in the provision of a packaging arrangement of the type described which is particularly suitable for the packaging of a comestible product of extremely brittle nature necessitating the careful handling thereof, such as an analog bacon strip, comprising a generally cylindrical container adapted to receive a plurality of product-containing pouches and including a separator member biasing the pouches against the inner cylindrical wall surface of the container.

Yet another object of the present invention lies in the provision of a novel packaging arrangement, particularly suited for the packaging and storage of an easily fractured brittle product packed within pockets in vacuum-sealed pouches incorporating peelable seals comprising the combination of an inert gas-filled cylindrical container, at least one of the product-containing pouches being located in the cylinder and dimensioned so as to be restrained from axial movement therein, and a separator centrally positioned in the container for biasing the pouches towards engagement with the inner cylindrical wall of the container and to restrain the pouches from radial movement within the container.

BRIEF DESCRIPTION OF THE DRAWINGS

The foregoing and other objects and advantages of the novel packaging arrangement constructed pursuant to the teachings of this invention may be readily understood by one skilled in the art, reference being had to the following detailed description of preferred embodiments thereof, and taken in conjunction with the accompanying drawings; in which.

DETAILED DESCRIPTION OF THE DRAWINGS

Figure 1:
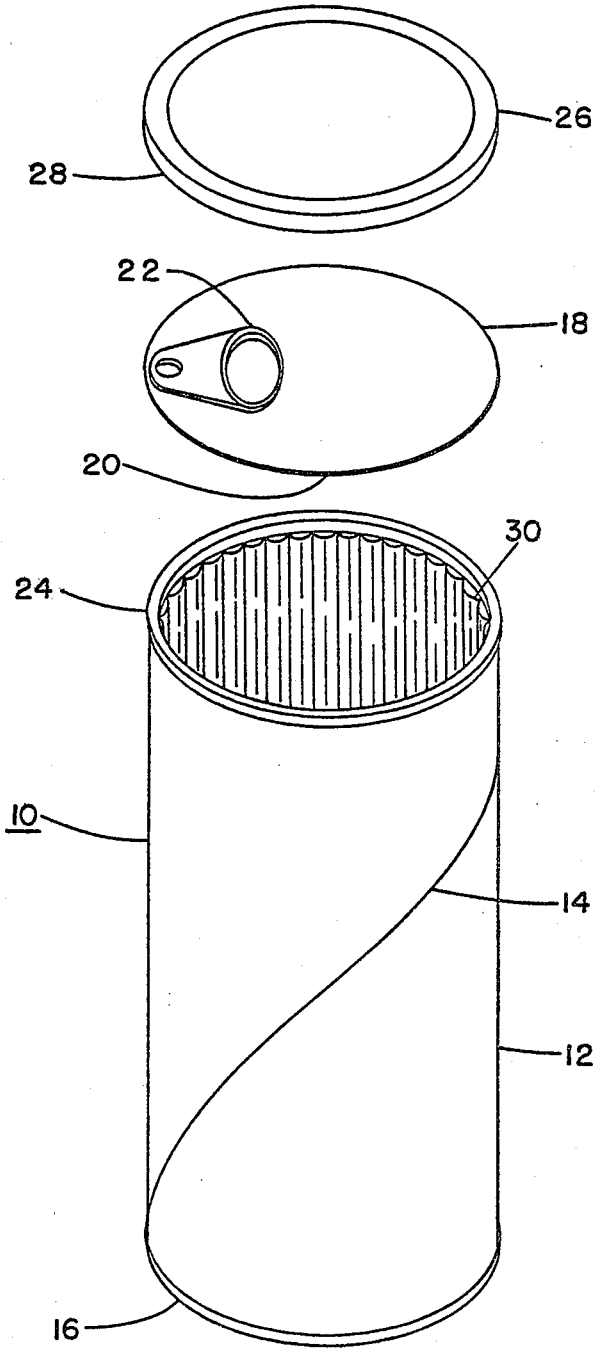
FIG. 1 is an exploded perspective view of an opened cylindrical container for the packaging of a comestible, such as analog bacon strips.

Referring now in detail to the drawings, in FIG. 1 there is illustrated an exploded perspective view of an outer package for a comestible product, such as analog bacon strips or the like, consisting of a cylindrical container 10. Container 10 may have its cylindrical portion 12 formed of four-ply spirally wound cardboard or paperboard joined together along a seam 14 in a manner well known in the art. The interior of the container may be lined with a suitable foil material, such as a foil polymer laminate, which will render the container gas-impervious for extensive periods of time during which it may be maintained in a stored condition. The container has a metal bottom 16 which may be formed of steel, and a metal top 18 which may be formed of aluminum. However, the container may be constructed of other combinations of materials, in effect, it may be formed entirely of cardboard or paperboard, or entirely of metals and plastics.

The top 18 is preferably, although not necessarily, an easy-open, peel-off type closure which is scored proximate its outer edge at 20 to facilitate removal of the top by means of a pull-tab 22. Removal of the top 18 causes an annular metal strip or beaded edge 24 to remain fastened to the top rim of the container 10 so as to facilitate reclosing of the opened container by a removable cover 26. The cover may be formed of a resilient plastic material having a depending flange portion 28 which will allow it to be easily removed from, or snapped on, the top edge 24 of the container.

The cylindrical container may include a corrugated liner 30, preferably of paper, which extends around the inside of the container so as to cover the cylindrical wall portion thereof and provides additional protection against breakage of the packaged product. In alternative embodiments of the invention, the corrugated liner may be replaced by different types of shock absorbent liners, such as foamed plastic, or the liner may even be eliminated entirely, particularly when the cylindrical container is constructed of a strong and shock-resistant material.

Figure 2:
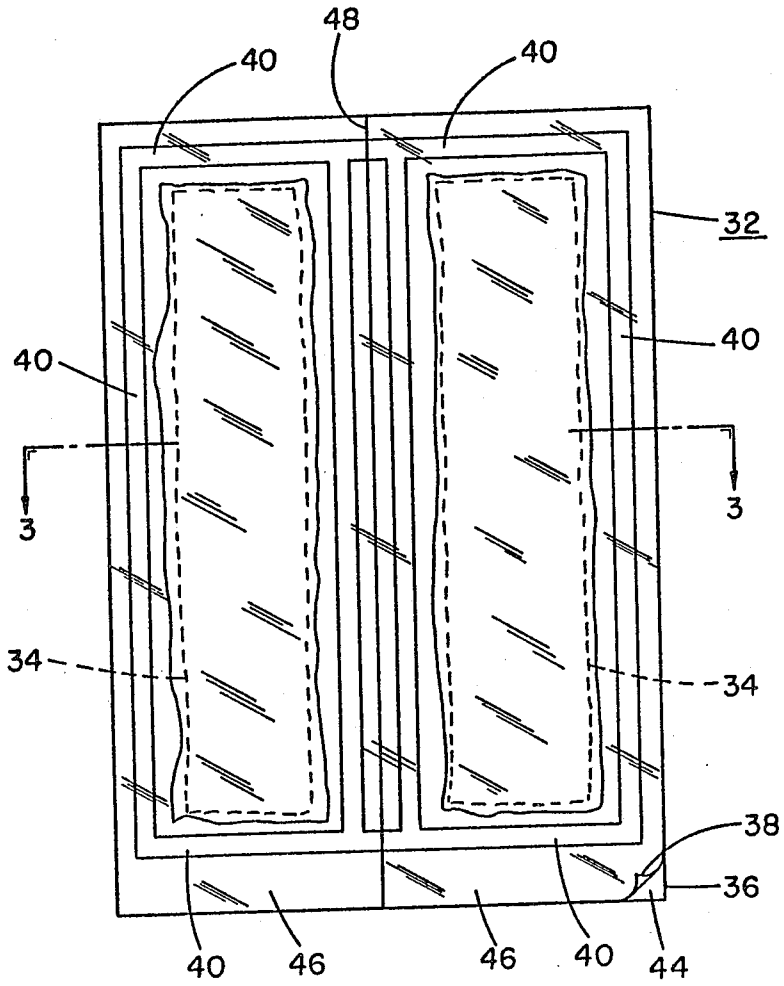
FIG. 2 illustrates a vacuum pouch having a pair of spaced stacks of analog bacon strips vacuum-packed therein in separately sealed pockets.
Figure 3:
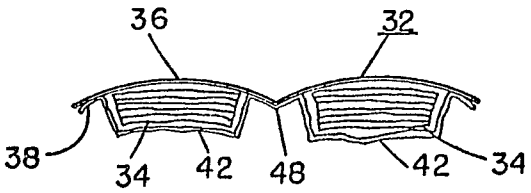
FIG. 3 is a sectional view taken along line 3—3 in FIG. 2.

FIGS. 2 and 3 illustrate an inner package 32 for analog bacon strips 34. The analog bacon strips, which are of flat, generally rectangular configurations, are superimposed in face-to-face relationship so as to form a stack containing about six strips. Of course, in different embodiments of the invention, other quantities of product may be placed in each stack. In general, the quantity of products in each stack will depend upon the type and shape of the product and the particular arrangement thereof. Two spaced-apart stacks of the analog bacon strips 34 are placed on a plastic material base sheet or film 36, and a top sheet or film of plastic 38 is applied over the base film and the product. Suitable vacuum is applied to the product, and the top film is then laminated along seams 40 to the base sheet or film plastic. The vacuum results in the top film being drawn in loosely over the analog bacon strips to form a vacuum pouch incorporating separate sealed pockets 42 in which the strips are held immobile between the top and bottom films of plastic. The two superposed product-sealing films of plastic are not sealed to each other outside of the laminated seams 40 so as to form a peelable seal by which they may be easily separated, as shown at 44, and peeled apart. This easy opening feature or peelable seal 44 of the pouch 32 is important since the analog bacon strips are very fragile and brittle and any difficulty in opening the pouch pockets 42 would increase the danger of breakage of the strips which wound render them unattractive from a consumer viewpoint. The packaging sequence described hereinabove is well known in the art, and may be accomplished on a Mahaffy Sureflow 902E machine, with the application of approximately 500 to 560 mm of mercury of vacuum to impart a correct degree of tightness of the film wrap around the product without resulting in breakage thereof. The plastic films sealing the analog bacon strips must be properly selected to provide the correct memory as the interior of the pouches and of the container are subjected to the vacuum and charged with nitrogen since, as the vacuum dissipates, the memory will still cause the film to cling to the product in the sealed pockets 42. The stacks of analog bacon strips are applied off-center onto the plastic sheets or film to thereby leave an elongated flange 46 along one edge of the plastic films.

Figure 6:
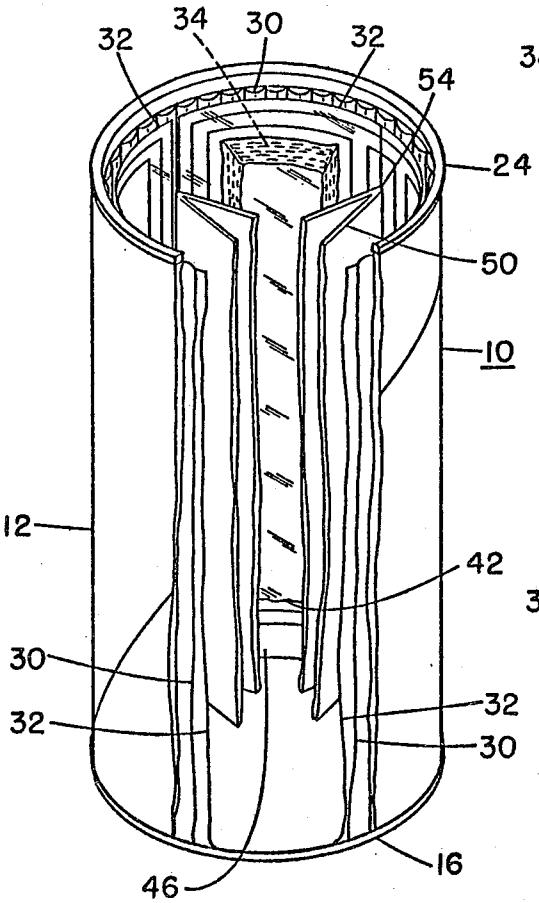
FIG. 6 is a view similar to FIG. 5 with a portion of the container shown cut away to afford a better view of the placement of the analog bacon strip pouches in the container.
Figure 5:
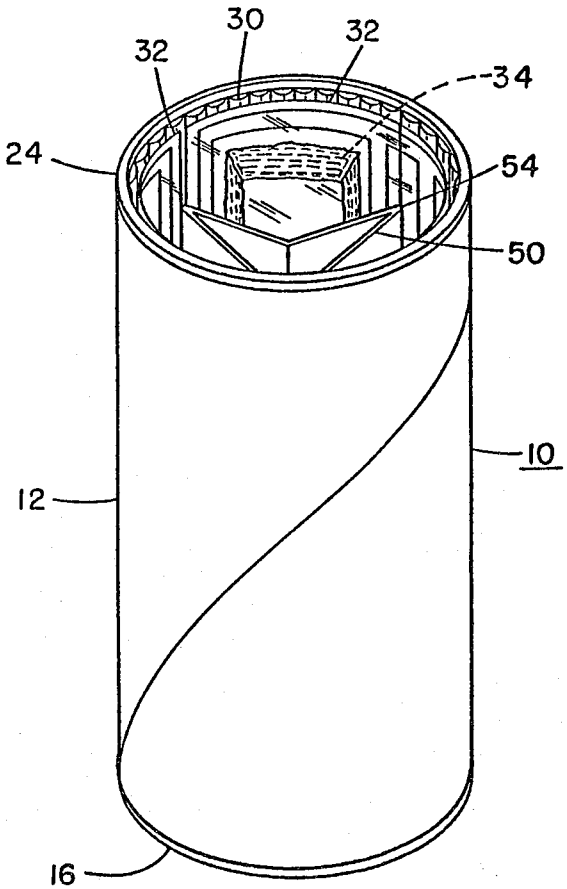
FIG. 5 is a perspective view of a packaging arrangement according to the invention showing pouches containing analog bacon strips placed in the cylindrical container with the separator holding the strips immobilized.

The lengths of the plastic film pouches are also sized to be in substantial conformance with the axial length of the cylindrical container 10. After the inner package consisting of the vacuum pouch 32 containing the stacked analog bacon strips in two pockets 42 is assembled, it is folded or creased widthwise along line 48 intermediate and in parallel with the pockets and placed, as shown in FIGS. 5 and 6, so as to extend along approximately one-half the circumference of the inner wall of the cylindrical container. The analog bacon strips are thus superimposed or stacked to extend radially towards the center of the cylindrical container 10, with the longitudinal axes of the strips extending along the longitudinal axis of the container, and with the bottom flange portion 46 of the pouch 32 resting on the inner surface of the bottom 16 of the cylindrical container. Two such pouches 32 each having two pockets 42 containing analog bacon strips, are placed in a contiguous manner within the cylindrical container 10, one on the far side, as shown in FIGS. 5 and 6, and a second one on the near side, which has been omitted from the drawings for purposes of clarity, so as to encompass practically the entire cylindrical circumference of the container. This results in a package having four stacks of analog bacon strips which are vertically or axially oriented within the cylindrical container 10, with each stack facing in a direction extending towards the center of the container. The outer or back surface of film 36 of the pouches 32 is in surface contact with the corrugated liner 30 which lines the circumferential or cylindrical inner wall of the container 10.

Figure 4:
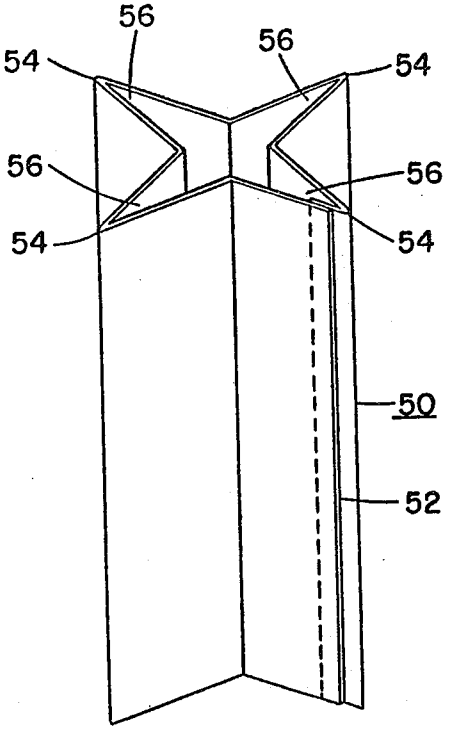
FIG. 4 is a perspective view of a star-shaped insert utilized as a separator in the cylindrical container for packaging analog bacon strips.

After insertion of both pouches 32 into the container, an insert or separator 50 as shown in detail in FIG. 4, may optionally be placed in the container 10 in the axial direction thereof so as to extend between the four illustrated individual stacks of analog bacon strips to thereby separate the stacks and hold them securely against the surface of the cylindrical container or the corrugated liner. In the illustrated embodiment of the invention, the insert is formed of an elongate sheet of cardboard folded into the shape of a four-pointed star in cross-section, and having the ends thereof glued together along an edge 52. As shown in the drawings, the points 54 of the star-shaped separator extend between the pockets 42 of the pouches 32 and bias the latter radially outwardly against the container 10. The four projections 56 forming the star-shape provide for essentially pie-like wedge-shaped spaces therebetween and the container in each of which there is located respectively one pocket 42 containing the strip product. The height of the separator may be somewhat less than the height of the container interior. In other embodiments of the invention, the four-pointed star insert 50 may be replaced by other shaped inserts, such as a simple cross-shaped insert, or alternatively in some embodiments of the invention the insert may be omitted entirely. Moreover, the insert or separator may be constructed from a rigid or semi-rigid plastic material, or any other material suitable for this purpose.

Figure 8:
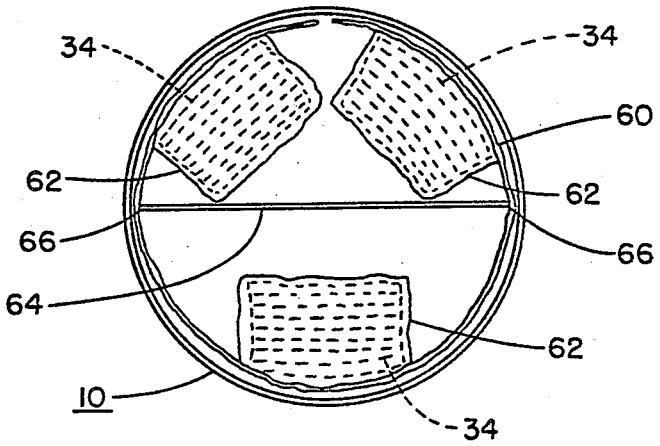
FIG. 8 is a top plan view of another embodiment of the inventive packaging arrangement.

In the embodiment of FIG. 8 of the drawings, in which components analogous or identical to those in the previously described embodiment are designated by the same reference numerals, the container 10 has an inner package 60 for analog bacon strips arranged therein. The inner package or pouch 60 is similar to that shown in FIG. 2, however, in this instance the pouch 60 is of a width so that, when inserted into the container 10, it will encompass about 360° or the entire inner cylindrical surface of the latter, rather than the 180° covered by each pouch 32. When the pouch 60 is provided with three pockets 62, each containing analog bacon strips 34, the pockets are arranged so as to be spaced about the inner cylindrical surface of container 10. A separator or spacer 64, preferably formed of a generally rigid flat cardboard plate, extends across the container 10 so as to diametrically bisect the latter. The end edges 66 of separator 64 are dimensioned to extend between the center pocket and each of the end pockets flanking the center pocket, to thereby bias the pouch 60 against the inner cylindrical surface of the container 10.

Figure 7:
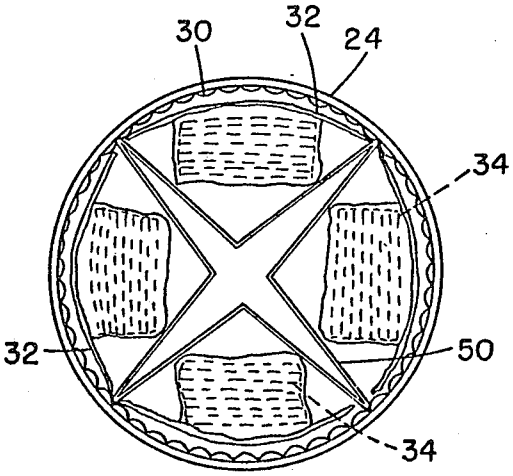
FIG. 7 is a top plan view of the packaging arrangement of FIG. 5, with the top closure member thereof having been removed.
Figure 9:
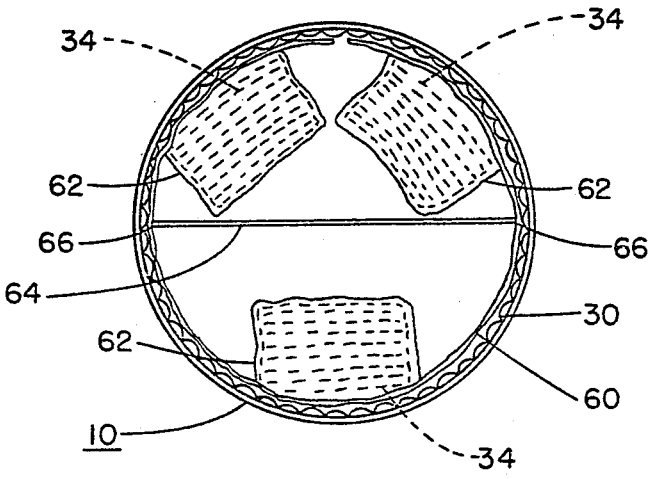
FIG. 9 is a view similar to that of FIG. 8 showing a modification of the packaging arrangement.

The embodiment of FIG. 9 is similar to that of FIG. 8, with the primary distinction being that a corrugated liner 30 is interposed between the outer surface of pouch 60 and the inner cylindrical surface of container 10. This will provide additional protection to the analog bacon strips 34 in the pouch pockets 62, as in the embodiment of FIGS. 5 to 7.

The container 10, prior to sealing thereof, may be filled with an inert gas, such as nitrogen, to protect the analog bacon strips or any comestibles stored therein from the adverse and deleterious effects of oxygen and moisture, and the container is then sealed by means of the top 18. This results in a container which protects the analog bacon strips contained therein against very high shock loads or impact levels in radial and axial directions with very little danger of breakage of the strips, and a container which is also very suitable for mass distribution in the consumer marketplace.

Although the packaging arrangement of the present invention has been described with reference to products consisting of analog bacon strips, it is readily apparent that other products of a similar fragile nature may be packaged in accordance with the teachings of the present invention. While preferred embodiments of the present invention have been disclosed in detail, the teachings of the present invention will suggest many alternative embodiments to those skilled in the art.

What is claimed is:

1. In a packaging arrangement for a generally fragile flat elongated product, the combination of:

a. a substantially rigid cylindrical container including a peelable top closure member and a bottom closure member forming a sealed container;

b. at least one product-containing pouch in said container positioned so as to conform to the inner cylindrical surface thereof having flange means formed along the bottom edge of said pouch in yieldable contact with the bottom closure member of said container for absorbing axial shock loads imparted to said container, said pouch having a plurality of vacuum-sealed pockets circumferentially spaced along the cylindrical inner circumference of said container, with each pocket being separated from each adjacent pocket by a seam extending longitudinally along the length of said cylindrical container, each of said vacuum-sealed pockets containing respectively one stack of said friable product held immobile in said pockets and stacked to extend radially toward the center of the container, each said pocket being vertically arranged in said cylindrical container with the length of the pocket extending along the height and parallel to the longitudinal axis of said container, and the length of each friable product extending along substantially the entire length of the pocket, said pouch being formed of a resilient plastic material laminate and creased in the axial direction of said container intermediate said pockets so as to facilitate conformance thereof to the contour of the inner cylindrical surface of said container, said pouch being of a height substantially in conformance with the axial length of said container intermediate the closure members thereof so as to be restrained from axial movements within said container, said pouch extending beyond the length of the product in said pockets to thereby maintain the product in a spaced relationship from said top and bottom closure members.

2. An arrangement as claimed in claim 1, comprising at least two of said product-containing pouches being contiguously positioned in said container along the inner cylindrical surface thereof, each pouch encompassing one-half of the cylindrical circumferential wall of said container, and flange means formed along the bottom edge of each said pouch in yieldable contact with the bottom closure member of said container for absorbing axial shock loads imparted to said container.

3. An arrangement as claimed in claim 1, comprising an inert gas filling said sealed container to protect the product in said pouches from deleterious effects of oxygen and moisture.

4. An arrangement as claimed in claim 1, comprising a corrugated liner extending along the inner circumferential wall surface of said cylindrical container, said liner being interposed between said inner wall surface and the adjacent surface of said pouch.

5. An arrangement as claimed in claim 4, said corrugated liner being formed of paperboard.

6. An arrangement as claimed in claim 1, said pouch being formed of superposed first and second plastic film sheets, said film sheets being sealed about each of said stacks of product to thereby form said product-containing pockets.

7. An arrangement as claimed in claim 1, said product comprising elongate strips of analog bacon, a plurality of said strips being superimposed to form respectively one said stack, said strips being arranged in the pockets of said pouch so as to extend in parallel with the longitudinal axis of said cylindrical container.

8. An arrangement as claimed in claim 1, said pouch comprising three of said product-containing pockets, said pouch extending along substantially the entire circumferential length of the inner cylindrical surface of said container so as to have the end edges thereof in a substantially contiguous relationship, said pockets being generally equidistantly spaced along said cylindrical container surface.

9. An arrangement as claimed in claim 1, comprising a detachable cover member adapted to be mounted on said cylindrical container for closing said container upon removal of said top closure member.

10. An arrangement as claimed in claim 9, said detachable cover member being formed of a plastic material.

* * * * *